US005150977A

United States Patent [19]

Yoshikawa

[11] Patent Number: 5,150,977

[45] Date of Patent: Sep. 29, 1992

[54] RECORDING APPARATUS WITH DETECTOR FOR PAPER EDGE AND END OF RIBBON SENSING

[75] Inventor: Junichi Yoshikawa, Yokohama, Japan

[73] Assignee: Canon Kabushiki Kaisha, Tokyo, Japan

[21] Appl. No.: 809,248

[22] Filed: Dec. 18, 1991

Related U.S. Application Data

[63] Continuation of Ser. No. 322,920, Mar. 14, 1989, abandoned.

[30] Foreign Application Priority Data

Mar. 15, 1988 [JP] Japan ..... 63-59456
Feb. 27, 1989 [JP] Japan ..... 1-43301

[51] Int. Cl.[5] ..... B41J 35/36; B41J 35/20; B41J 29/44

[52] U.S. Cl. ..... 400/703; 400/249; 400/708

[58] Field of Search ..... 400/212, 216, 216.1, 400/216.2, 703, 705, 708, 711, 219, 238, 239, 249

[56] References Cited

U.S. PATENT DOCUMENTS 4,272,204 6/1981 Quinn, Jr. et al. ..... 400/708

FOREIGN PATENT DOCUMENTS 151088 8/1985 Japan ..... 400/249
31284 2/1986 Japan ..... 400/249
63471 4/1986 Japan ..... 400/249
175069 8/1986 Japan ..... 400/703
39272 2/1987 Japan ..... 400/249
158083 7/1987 Japan ..... 400/249

*Primary Examiner*—David A. Wiecking
*Attorney, Agent, or Firm*—Fitzpatrick, Cella, Harper & Scinto

[57] ABSTRACT

An image recording apparatus for recording to a recording medium comprises an ink sheet cassette to mount an ink sheet having an ink, a carriage to mount an ink sheet cassette, a platen to mount a recording medium, a recording head for transferring the ink of the ink sheet to the recording medium to thereby record to the recording medium, an alarm portion provided for the ink sheet in order to warn of the end of ink sheet in the cassette, and a sensor which is commonly used to detect both the size of recording medium set onto the platen and the alarm portion. The alarming portion is formed by adhering or printing a high reflectance material such as a metal foil to the end portion on the back surface of the ink sheet. When the carriage scans the recording medium or platen surface in the lateral direction, the carriage is shifted up together with the ink sheet and the photo sensor automatically detects the presence or absence of the recording sheet on the basis of the difference between the reflectances of the sheet and platen and can detect an image recording region. With this apparaatus, the image recording can be certainly executed with a high reliability at a low cost.

8 Claims, 9 Drawing Sheets

FIG. 7A
FIG. 7
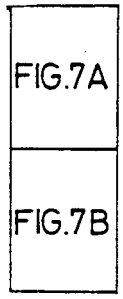
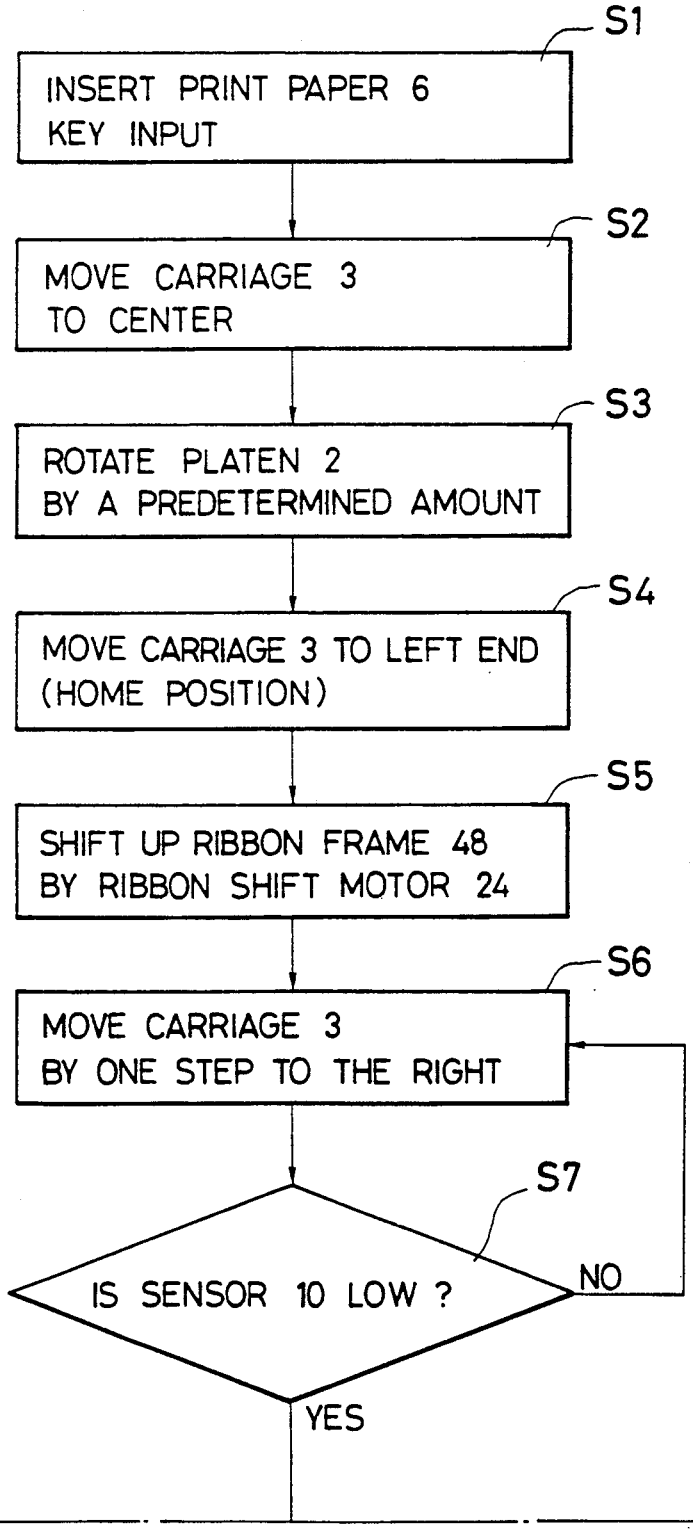

RECORDING APPARATUS WITH DETECTOR FOR PAPER EDGE AND END OF RIBBON SENSING

This application is a continuation of application Ser. No. 07/322,920 filed Mar. 14, 1989, now abandoned.

BACKGROUND OF THE INVENTION

1. Field of the Invention

The present invention relates to a recording apparatus for recording on a recording medium and, more particularly, to a recording apparatus in which an ink is transferred from an ink sheet having the ink to a recording medium on thereby record to the recording medium.

The recording apparatus includes a printer, an electronic typewriter, a word processor, a copying machine, a facsimile apparatus, or the like. On the other hand, a well-known recording system such as impact type, non-impact type, or the like can be used as a recording system which is applied to the invention.

2. Related Background Art

Hitherto, a recording apparatus using an ink ribbon has been known in an impact printer, a thermal copy transfer printer, or the like. In such a kind of apparatus, there has been known a control system in which the end of the effective portion of the ink ribbon is detected by a photo sensor or the like and when the end of ribbon is detected, the ribbon end is indicated or the operation of the apparatus is stopped.

By using such a control system, it is prevented such an inconvenience that the recording is continued without being conscious of the end of ink ribbon and the ink ribbon is completed during the recording operation, so that a defective recording occurs.

On the other hand, a recording paper to which the recording is executed is not limited to the regular size paper but there are many papers of various kinds of sizes such as different lengths, widths, and the like. Therefore, there has been known a recording apparatus having a function such as to detect a size of recording paper and thereby inhibit recording to be executed in a region without the recording paper, for instance, a region of a platen or the like, or a function such as to automatically set right and left margins.

However, hitherto, the ink ribbon end sensor to detect the end of ink ribbon and the recording paper sensor to detect the size of recording paper are respectively independently provided. Therefore, there is a problem such that the detecting system becomes complicated or it is difficult to reduce the cost. To eliminate such a problem, it is also considered to omit the ink ribbon end detecting function or recording paper size detecting function. However, in such a case, the deterioration of the performance of the apparatus is caused.

SUMMARY OF THE INVENTION

It is an object of the present invention to provide a recording apparatus of a high reliability.

Another object of the invention is to provide a recording apparatus which can prevent the defective recording.

Still another object of the invention is to provide a recording apparatus which can improve the operating performance of the apparatus.

Still another object of the invention is to provide a recording apparatus which can miniaturized the apparatus.

Still another object of the invention is to provide a recording apparatus which can reduce the costs of the apparatus.

Still another object of the invention is to provide a recording apparatus having a function to detect the end of an ink sheet and a function to detect a size of a recording medium.

Still another object of the invention is to provide a recording apparatus in which by detecting a size of a recording medium, a recording area corresponding to the size can be automatically set.

Still another object of the invention is to provide a recording apparatus to which an ink ribbon cassette having an ink ribbon therein is attached and which performs the recording to a recording medium through the ink ribbon by a predetermined recording system, wherein the recording apparatus comprises: detecting means which is arranged so as to face the ink ribbon and detects an end of an effective portion of the ink ribbon; and control means for moving the ink ribbon cassette and removing the ink ribbon cassette from the position in front of a detecting section of the detecting means, and in this state, for scanning the detecting means to thereby detect an end portion of the recording medium.

BRIEF DESCRIPTION OF THE DRAWINGS

FIGS. 7, 7A, 7B and 8 are flowcharts showing control procedures for an MPU in FIG. 6, respectively.

DESCRIPTION OF THE PREFERRED EMBODIMENTS

Figure 1:
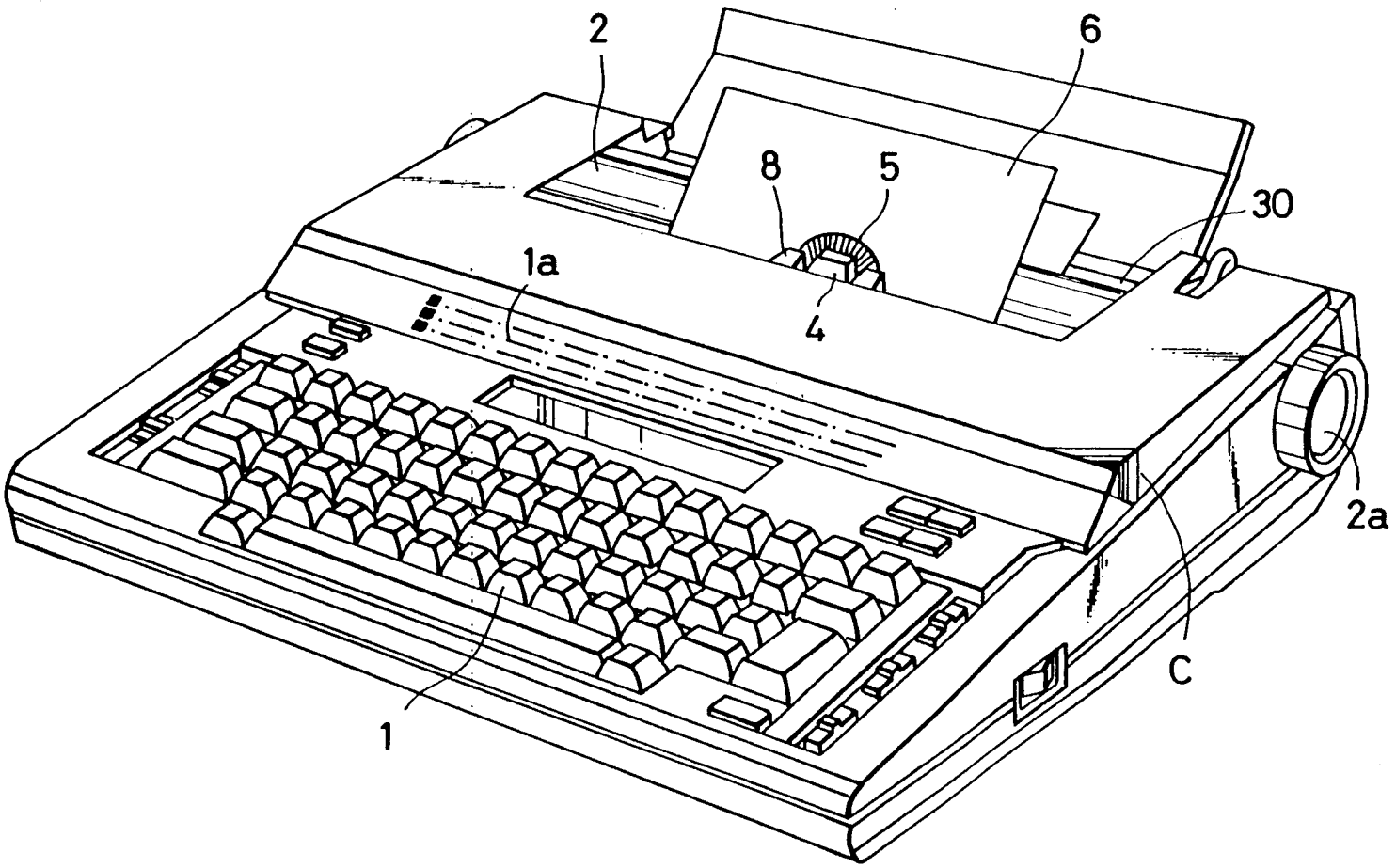
FIG. 1 is an external perspective view of an electronic typewriter to which an embodiment of the present invention is applied.

The present invention will be described in detail hereinbelow on the basis of an embodiment shown in the drawings.

Figure 2:
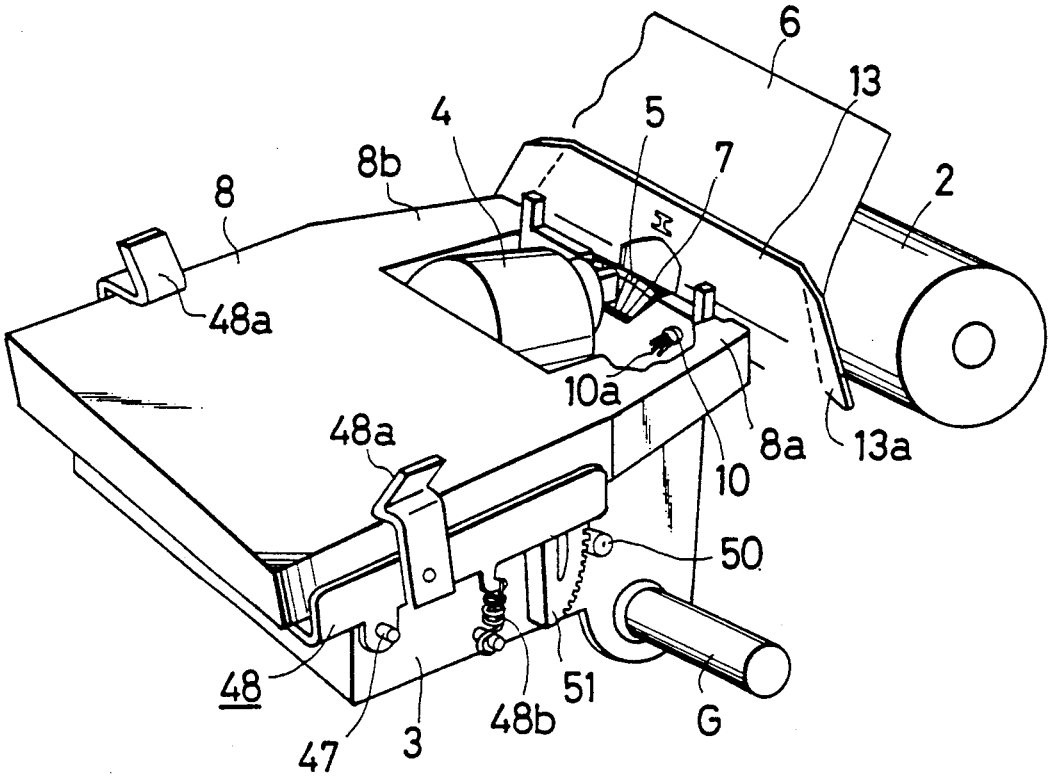
FIG. 2 is a perspective view showing a recording mechanism of the apparatus of FIG. 1.
Figure 3:
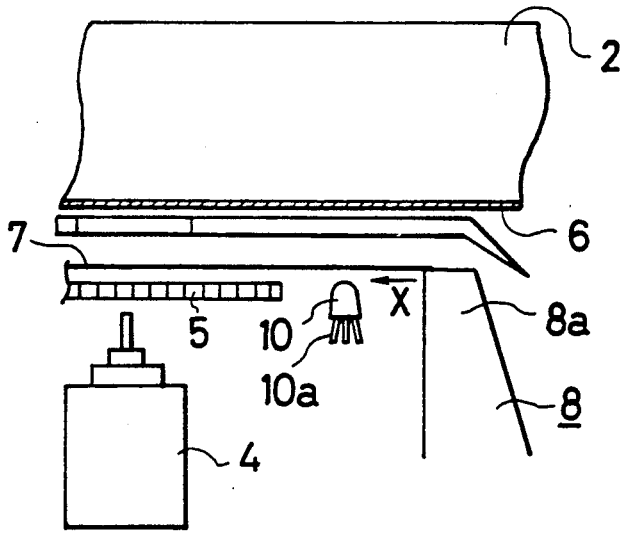
FIG. 3 is a top view of a main section of the construction in FIG. 2.
Figure 4A:
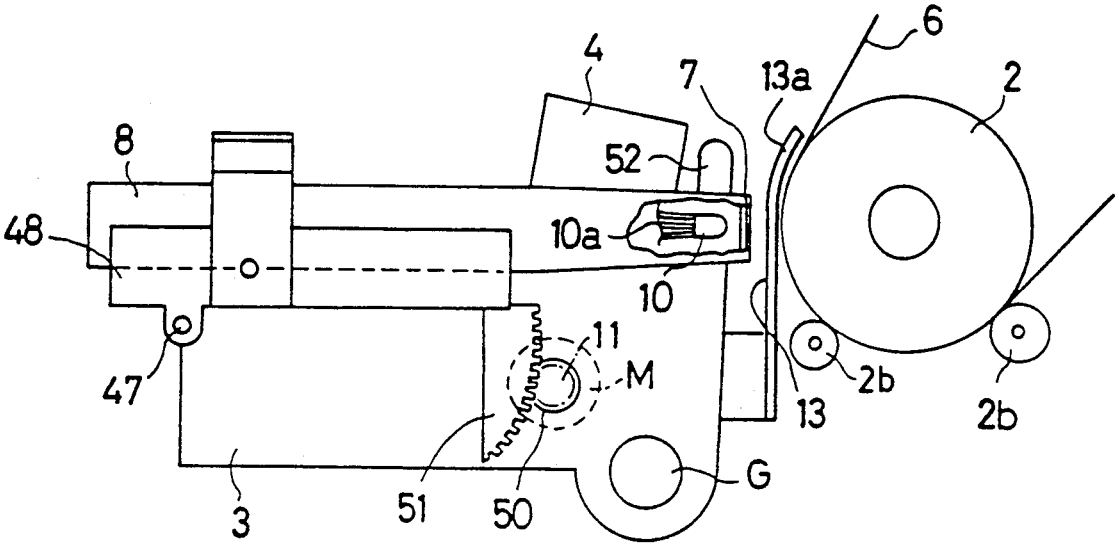
FIGS. 4A and 4B are side elevational views showing the operation of the recording mechanism of FIG. 2.
Figure 4B:
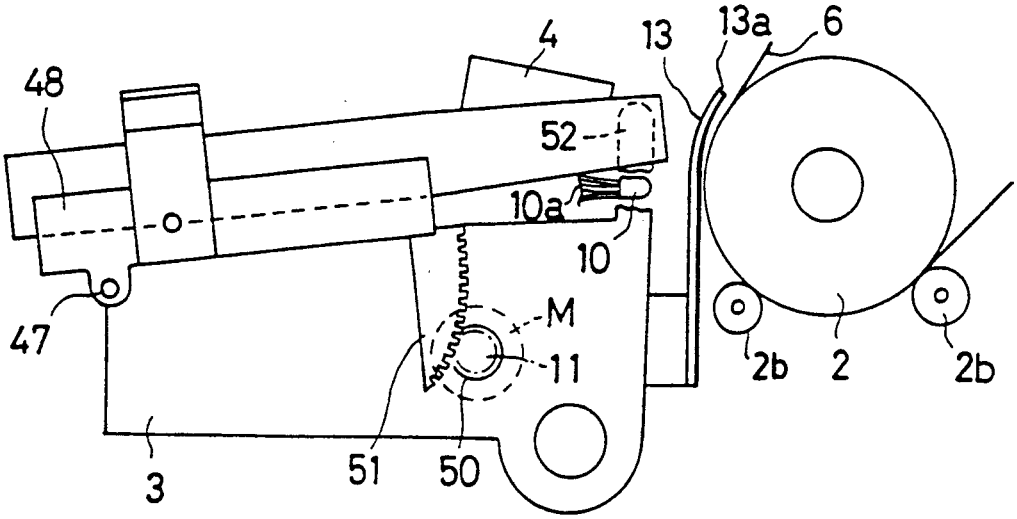
Figure 4D:
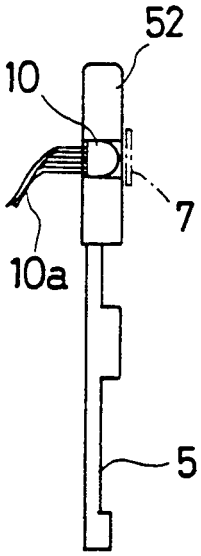
FIG. 4D is a cross sectional view taken along the line A—A in FIG. 4C.
Figure 4C:
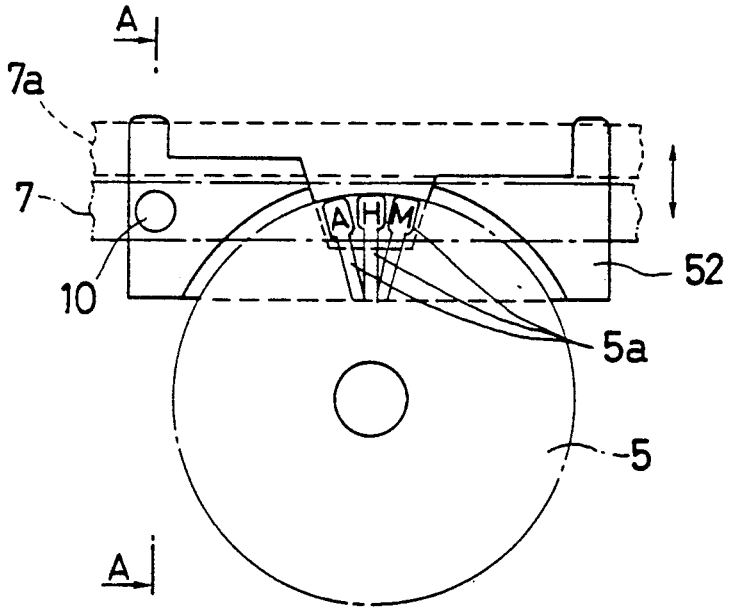
FIG. 4C is a front view of a sensor portion of the recording mechanism when it is seen from the side of a platen.

FIG. 1 is an external perspective view of an electronic typewriter according to a type impact system as an example of a recording apparatus to which the invention is applied. FIG. 2 is a perspective view of a recording mechanism portion of the typewriter shown in FIG. 1. FIG. 3 is a plan view of the recording mechanism portion shown in FIG. 2. FIG. 4A is a side elevational view showing a recording state of the recording mechanism portion. FIG. 4B is a side elevational view showing a standby state of an ink cassette of the recording mechanism portion. FIG. 4C is a front view of a sensor portion of the recording mechanism when it is seen from the side of a platen. FIG. 4D is a cross sectional view taken along the line A—A in FIG. 4C.

In FIG. 1, reference numeral 1 denotes a keyboard to input image information such as characters, numerals, or the like. Alphabet keys and the like are arranged on the keyboard 1 on the basis of a predetermined pattern (in the diagram, the indications of the keys are not shown). Reference numeral la indicates a display unit to display the information input by the key operation. An image recording mechanism is enclosed in a cover C provided in the portion behind the keyboard 1. The image recording mechanism mainly has: a platen 2 to convey a recording medium 6 (for instance, ordinary paper, processed paper, OHP sheet, etc.) onto which an image is recorded; a recording head 4; a daisy wheel 5 in which a number of types 5*a* are arranged in the outer peripheral portion; and a ribbon cassette 8 having therein an ink ribbon. The recording head 4, daisy wheel 5, and ribbon cassette 8 are mounted on a carriage 3, which will be explained hereinafter. Reference numeral 2*a* denotes a feed knob. By manually rotating the feed knob 2*a*, the platen 2 can be rotated, so that a recording medium 6 mounted on the typewriter main body is manually conveyed.

FIG. 2 shows the details of the recording mechanism of FIG. 1.

In FIG. 2, the platen 2 is a roller and is automatically rotated by driving means (FIG. 6) such as a motor 27 or the like or is manually rotated by the knob 2*a*, thereby conveying the wound recording medium 6 in the direction perpendicular to the scanning direction of the recording head 4. In a state in which the recording medium 6 mounted on the apparatus main body is supported to the platen 2, the recording medium 6 is pressed by a recording medium guide 13 made of a transparent material or the like fixed at a front portion of the carriage 3. The carriage 3 moves in the direction X in FIG. 3.

The recording head 4 is mounted onto the carriage 3 as mentioned above. The carriage 3 scans in the lateral direction by driving means (FIG. 6) such as a motor 25 or the like along a guide rail G arranged in parallel with the platen 2. The recording head 4 has a print hammer (not shown) which is driven by a solenoid 26 or the like in accordance with image information and strikes the types 5*a* of the daisy wheel 5 from the back side.

The daisy wheel 5 is rotated by the motor 26 (FIG. 6) or the like and is controlled in a manner such that a predetermined type 5*a* corresponding to the image information is moved to a position in front of the hammer of the recording head 4. On the other hand, an ink ribbon 7 enclosed in the ribbon cassette 8 is reeved between arms 8*a* and 8*b* which are projected toward the front side of the ribbon cassette 8 so as to surround the recording head 4. The new portion of the ink ribbon 7 is always fed to a position in front of the recording head 4 by driving means (not shown).

When the hammer of the recording head 4 strikes the type 5*a* of the daisy wheel 5 selected in accordance with the image information, the type 5*a* presses the recording medium 6 supported to the platen 2 through the ink ribbon 7, so that the ink is transferred onto the recording medium 6 and the image is formed onto the recording medium 6.

Figure 6:
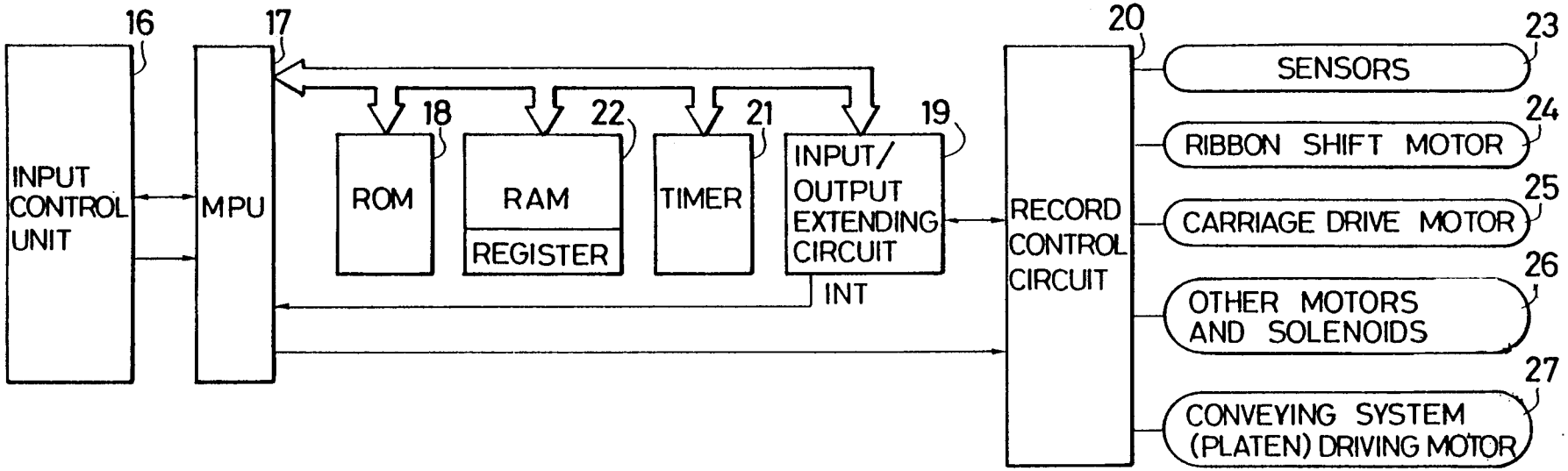
FIG. 6 is a block diagram of a control system of the apparatus of FIG. 1.

In the embodiment, a photo sensor 10 is held to the carriage 3 in order to detect the end portion of the ink ribbon 7 enclosed in the ribbon cassette 8. 10*a* designates an electrical connector for connecting the photo sensor 10 with a record control circuit 20 as shown in FIG. 6. The photo sensor 10 is located on the inside of the arms 8*a* and 8*b* of the ribbon cassette 8 and is embedded in a ribbon guide 52 toward the mounting direction of the recording medium 6 and scans the ink ribbon 7 from the back side thereof (refer to FIGS. 3, 4C, and 4D). The photo sensor 10 is a reflection type photo sensor comprising a light emitting section and a photo sensitive section and detects the back surface of the ink ribbon 7, thereby detecting the end portion of the ink ribbon 7 on the basis of the difference between the reflected light amounts. The ribbon guide 52 is fixed to the carriage 3 and guides the ribbon 7 to a position in front of the type 5*a*. The end portion is provided at the end of the ink ribbon 7 or on the back surface in the recordable region thereof. In the case where the end portion is provided on the back surface of the recordable region, the end of the ribbon is warned beforehand.

The ribbon cassette 8 is supported over the carriage 3 through a frame 48. The frame 48 is swingably supported to the carriage 3 around a shaft 47 as a pivot axis. A clip 48*a* detachably sets the ink ribbon cassette 8 to the frame 48. A rack portion 51 is provided in the lower portion of the frame 48. The rack portion 51 comes into engagement with a pinion gear 50 fixed to a rotating shaft 11 of a ribbon shift motor 24 (FIG. 6) mounted to the carriage 3. Further, a spring 48*b* is attached between the frame 48 and the carriage 3. The spring 48*b* is used to apply a downward tension to the frame 48.

With the foregoing construction, by rotating the pinion gear 50 by the motor 24, the frame 48 is vertically rotated around the shaft 47 as a center. Therefore, the ribbon cassette 8 is swung through the frame 48 as shown in FIG. 4A (recordable state) and FIG. 4B (standby state). In the recordable state, as shown in FIG. 4A, the ribbon cassette 8 is swung to the downward position and the ink ribbon 7 faces the daisy wheel 5. In such a state, the photo sensor 10 can detect the ink ribbon 7 from the back side as shown in the diagram.

On the other hand, when the pinion gear 50 is rotated clockwise, the ribbon cassette 8 is upwardly swung as shown in FIG. 4B around the shaft 47 as a center through the frame 48 and is set into the standby state. Thus, the ink ribbon 7 reeved to the arm 8*a* of the ribbon cassette 8 rises to the upward position of the daisy wheel 5.

At this time, the ink ribbon 7 does not exist at the position in front of the photo sensor 10 due to the swing of the ribbon cassette 8 and the photo sensor 10 faces the recording medium 6 on the platen 2 through a translucent material 13*a* of the recording medium guide 13.

In the recording state shown in FIG. 4A (the state shown by an alternate long and short dash line in FIG. 4C), the photo sensor 10 detects a reflectance of the back surface of the ink ribbon 7 at a predetermined timing. A material of a high reflectance such as a metal foil or the like is adhered onto the back surface near the end portion of the ink ribbon 7. The other portion of the back surface of the ink ribbon 7 is black. It is assumed that the photo sensor 10 outputs a high level signal in the region other than the ribbon end portion and outputs a low level signal when the material of a high reflectance of the end portion is detected.

On the other hand, by shifting up the ribbon cassette 8 into the standby state shown in FIG. 4B (the state shown by a broken line in FIG. 4C) at a desired timing (for instance, when the recording medium 6 is mounted or the like) the photo sensor 10 faces the recording medium 6 on the platen 2 as mentioned above. The position of the ink ribbon 7 is designated by a numeral *7a* in FIG. 4C. By laterally scanning the carriage 3 in such a standby state, the photo sensor 10 is also laterally scanned and detects the reflectance of the material on the platen 2. In general, the recording medium 6 such as a paper or the like is a high reflectance material of white or the like and the platen 2 is a low reflectance material such as a black rubber or the like. Therefore, the photo sensor 10 can detect the end position of the recording medium 6 on the basis of the difference between the reflectances of both materials.

Figure 5:
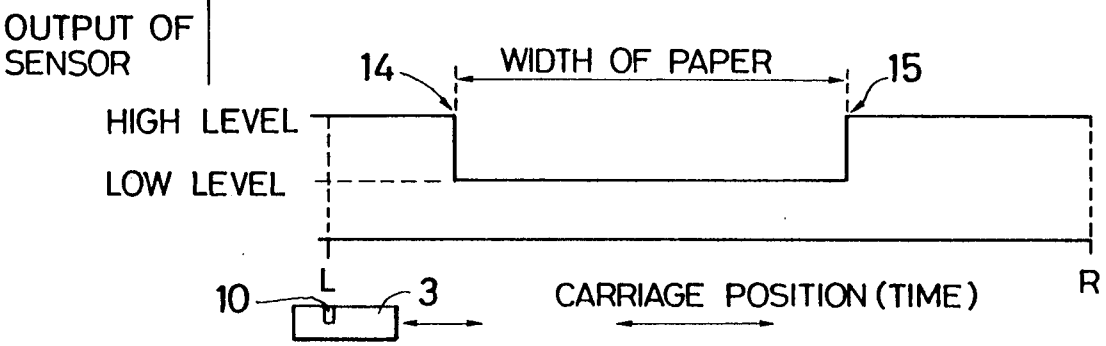
FIG. 5 is a timing chart showing an output of a photo sensor in FIG. 2.

FIG. 5 shows a change in output of the photo sensor 10 in the case where the carriage 3 is moved in the width direction of the platen 2 in the standby state shown in FIG. 4B (the state shown by the broken line in FIG. 4C).

As shown in the diagram, when the carriage 3 is moved from the left end to the right end by a driving mechanism such as the motor 25 or the like, the output level of the photo sensor 10 changes from the high level to the low level since the sensor 10 detects a left end L of the recording medium 6 at a timing 14. Similarly, when the sensor 10 detects a right end R of the recording medium 6 at a timing 15, the output level changes from the low level to the high level. Therefore, by making the change point of the detection level correspond to the scanning position of the carriage 3, the width of the recording medium 6 and the position for the platen 2 can be recognized.

FIG. 6 now shows a structure of a control system for controlling the foregoing recording mechanism.

In FIG. 6, reference numeral 16 denotes an input control unit to transmit input information from the keyboard 1. The input information from the keyboard 1 is input to an MPU (microprocessing unit) 17. The MPU 17 is connected to each of the components provided at the next stage through an address and data bus D.

First, reference numeral 18 denotes an ROM in which a program, which will be explained below, is stored and 22 indicates an RAM which is used as a buffer memory for recording data or the like. Various kinds of registers for control are set in the RAM 22.

On the other hand, reference numeral 21 denotes a timer. The MPU 17 executes the control in accordance with the count timing of the timer 21. Reference numeral 19 denotes an input/output extending circuit comprising an input/output (I/0) port and the like. Through the record control circuit 20, the extending circuit 19 controls sensors 23 and mechanisms such as: the ribbon shift motor 24 to rotate the pinion gear 50 shown in FIG. 2 to thereby shift up or down the ribbon cassette 8; carriage motor 25 to drive the carriage; the other motors and the solenoids 26 (for instance, rotation of the daisy wheel 5, striking of the hammer of the head 4, and the like); motor 27 to drive the conveying system such as a platen or the like; and the like.

The sensors 23 include the photo sensor 10 and the other necessary sensors. The detection signal of the photo sensor 10 is input to the extending circuit 19 through the record control circuit 20. The extending circuit 19 instructs the interruption to the MPU 17 as necessary and informs the detecting state of the sensor 10 to the MPU 17 and controls the recording mechanism on the basis of the detection information.

The foregoing operation control will now be described with reference to flowcharts shown in FIGS. 7 and 8.

Figure 7B:
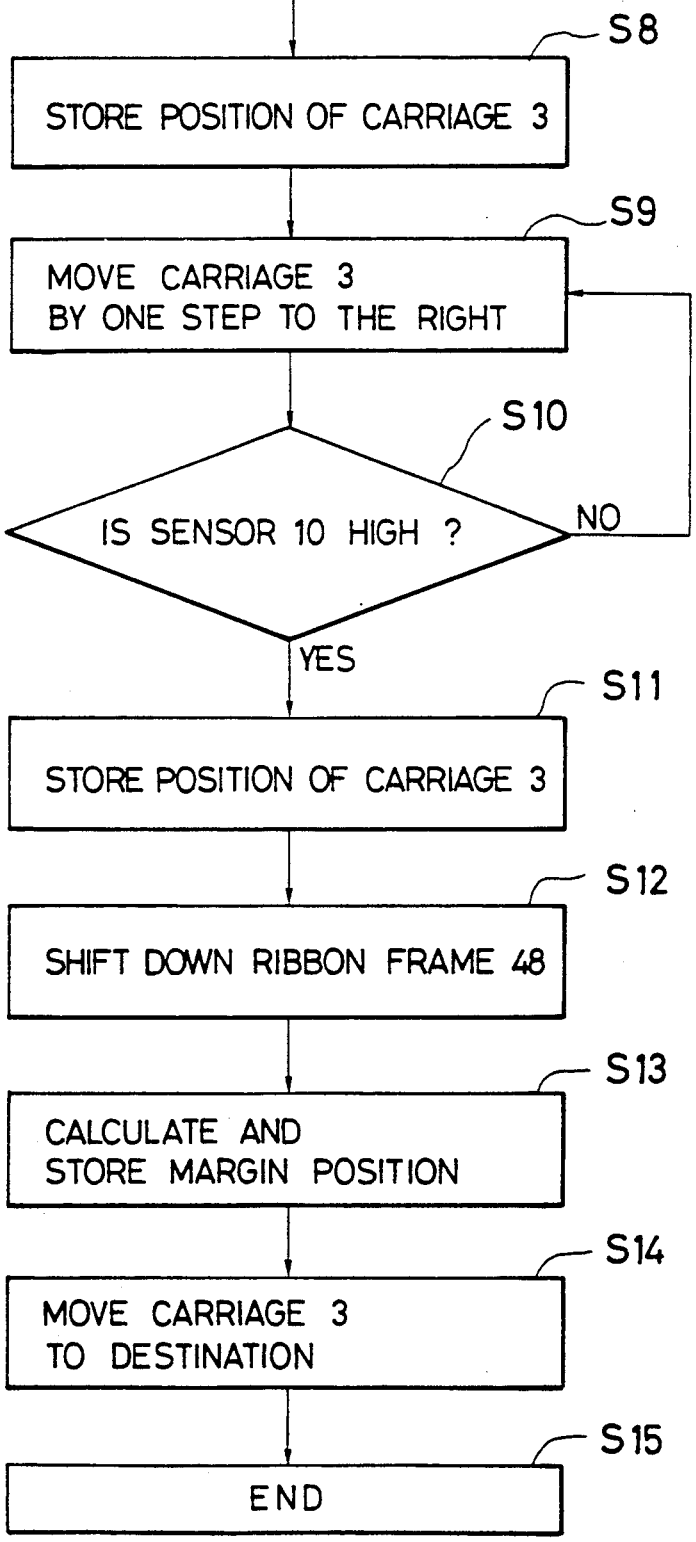

FIG. 7 is the flowchart for detecting the positions of the left and right end portions of the recording paper 6 by the photo sensor 10 when the recording paper is inserted and for automatically setting a margin (image recording area). A control program to execute such processes is stored in the ROM 18.

First, in step S1, the recording paper 6 is inserted from a paper inserting port 30 of the typewriter to the position at which the paper 2 reaches the platen 2 by the manual operation, thereby setting the paper 6. Paper insertion information is input by depressing a paper inserting key (input means of a top of form or an automatic paper feed or the like) of the keyboard 1. Each of the steps, which will be explained below, is executed by the depression of the paper inserting key.

In step S2, the recording medium guide 13 in the standby state presses the paper 6 and the carriage 3 is moved to a position near the center of the recording width. Due to such an operation, the paper 6 is set into a state in which it can be smoothly fed. In the next step S3, the platen 2 is rotated by a predetermined amount to automatically feed the paper 6 to the recording position. In step S4, the carriage 3 is moved to the home position (left end of the recording width). In step S5, the ribbon shift motor 24 is driven to shift up the ribbon cassette 8, thereby setting the cassette into the state shown in FIG. 4B (the state indicated by the broken line in FIG. 4C).

In step S5, the ribbon shift motor 24 is driven to shift up the ribbon cassette 8, thereby setting the cassette 8 into the state shown in FIG. 4B.

In step S6, the carriage motor 25 is driven to move the carriage 3 to the right by one step (or a predetermined distance). In step S7, the output level of the photo sensor 10 is checked. If the output is at the high level, this means that the surface of the platen 2 is detected and no recording paper 6 exists at that position. Therefore, the processing routine is returned to step S6 and the same operation is repeated.

On the contrary, if the output of the photo sensor 10 is at the low level in step S7, this means that the recording paper 6 exists at that position. Therefore, the information indicating that the position of the carriage 3 at that time point is at the left end of the recording paper 6 is stored into a register of the RAM 22 in step S8. Then, step S9 follows.

In step S9, the carriage 3 is further moved by one step (or a predetermined distance). The output level of the photo sensor 10 is checked in step S10. If the output is at the low level, the recording paper 6 exists at that position. Therefore, the processing routine is returned to step S9 and the same operation is repeated.

In the next step S10, when the change from the low level to the high level of the output of the photo sensor 10 is detected, this means that the surface of the platen 2 is again directly detected at that position. Therefore, the information indicating that the position at that time point is at the right end of the recording paper 6 is stored into the RAM 22 in step S11. In step S12, the ribbon shift motor 24 is driven to thereby return the ribbon cassette 8 to the position in the recordable state shown in FIG. 4A (the state indicated by the alternate long and short dash line in FIG. 4C).

In the next step S13, positions which are located inside by a predetermined amount (for instance, it is specified to one inch, or a predetermined length can be also set by the operator by a key input or the like) from each position of the left and right ends of the paper 6 are calculated. The calculated positions are stored as positions of the left and right margins into the RAM 22. In step S14, the carriage 3 is moved to the home position. In step S15, the processing routine is finished and the apparatus waits for the input of a "record command" or a "print command", which will be explained below.

Figure 8:
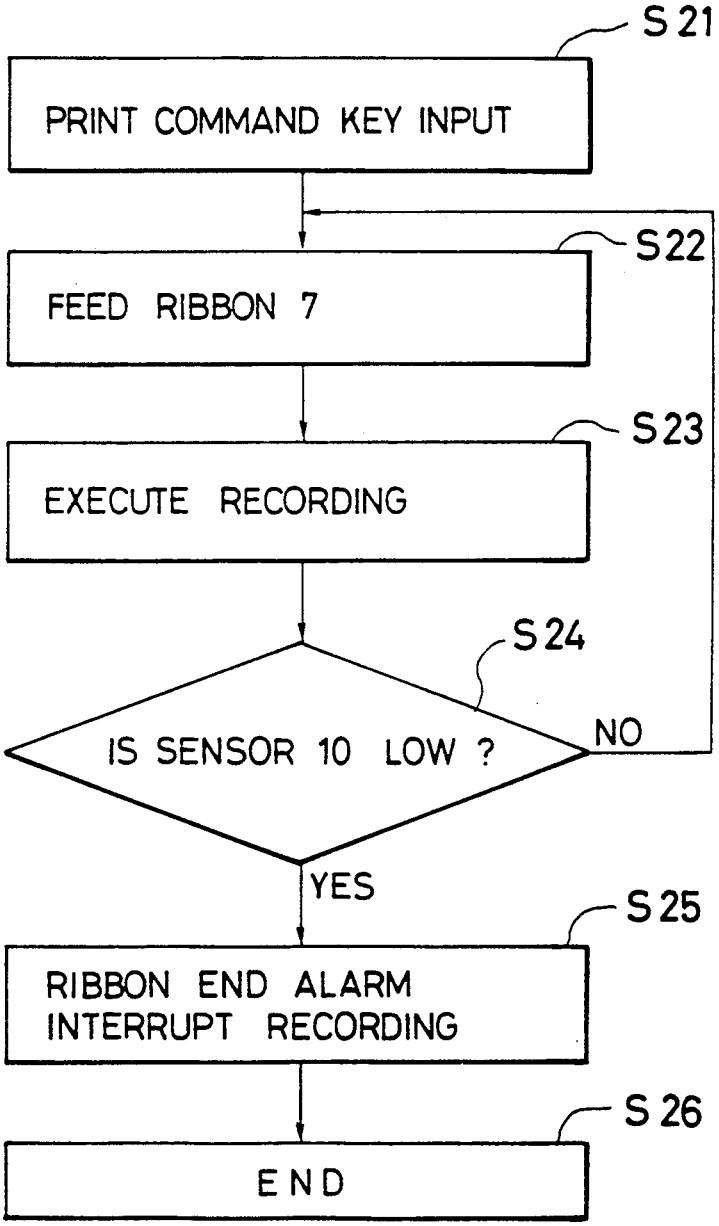

On the other hand, FIG. 8 shows the flowchart to detect the end portion of the ink ribbon 7 by the photo sensor 10. A control program to execute the processes is stored in the ROM 18.

First, the carriage 3 is in the state shown in FIG. 4A (the state indicated by the alternate long and short dash line in FIG. 4C). In step S21, a print command key of the keyboard 1 is depressed to input a print start command. In step S22, the ink ribbon 7 is taken up by only a predetermined amount corresponding to one character by a ribbon feeding mechanism (not shown) and is supplied to a position in front of the recording head 4. In step S23, a proper one of the types 5*a* of the daisy wheel 5 is selected and the position of the carriage 3 is moved or the like and, thereafter, an image is recorded onto the paper 6 by striking the hammer of the recording head 4.

In step S24, the output level of the photo sensor 10 is checked. If the output is at the high level, this means that the metal foil tape adhered on the back surface at the end of the ink ribbon 7 to alarm the ribbon end does not yet reach the position in front of the photo sensor 10. Therefore, a next image can be recorded and the processing routine is returned to step S22 as a recording sequence for the next character.

On the contrary, if the output is at the low level in step S24, this means that the metal foil tape as a high reflectance material adhered at the ink ribbon end has reached the position in front of the photo sensor 10. Therefore, in step S25, an alarm indicative of the ribbon end is generated to inhibit the execution of the next recording sequence. At the end in step S26, a series of sequence is completed, or the operator is made aware that the ribbon is ending and a predetermined image recording operation is continued.

Since FIG. 8 relates to the sequence during the recording, the ribbon cassette 8 is set at the position shown in FIG. 4A.

The image recording to the recording paper 6 is obviously executed within a range between the left and right margin positions specified in step S13 shown in FIG. 7 mentioned above.

According to the above embodiment, by using a translucent material as the recording medium guide 13, the light emitted from the photo sensor 10 and its reflected light can be transmitted through the guide 13, so that the photo sensor 10 can perform the detection.

Figure 9:
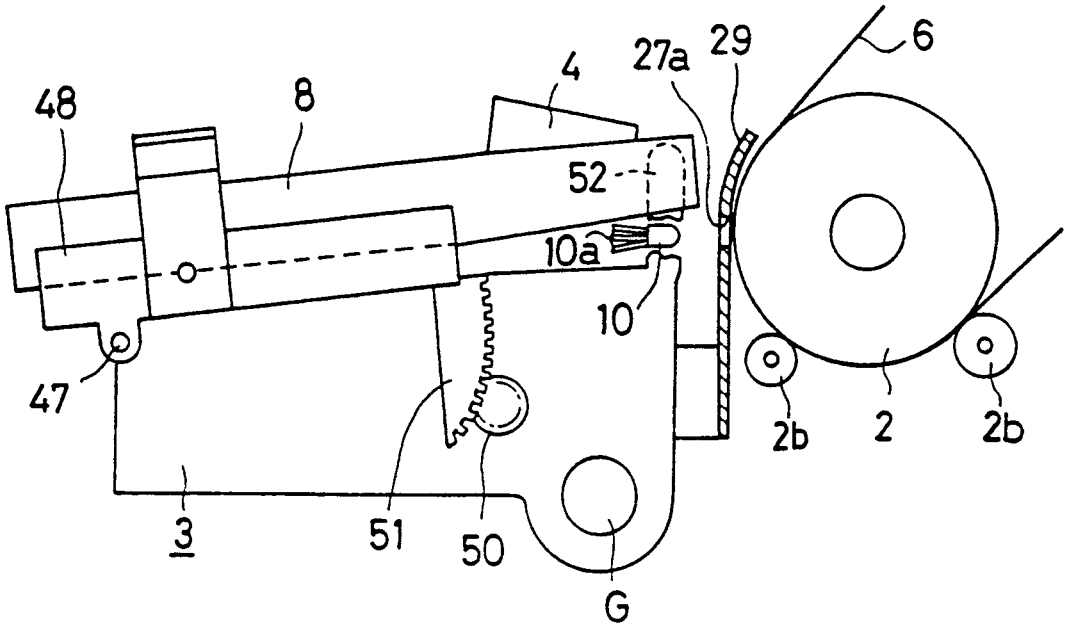
FIGS. 9 and 10 are side elevational views of different recording mechanisms, respectively.

However, as shown in FIG. 9, if a non-translucent material is used as a recording medium guide 29, an opening portion 27*a* is formed in the recording medium guide at a position corresponding to the light irradiating and reflecting path of the photo sensor 10, thereby directly exposing the platen or paper. By such a method, the recording medium guide can be also made of a non-translucent material.

Figure 10:
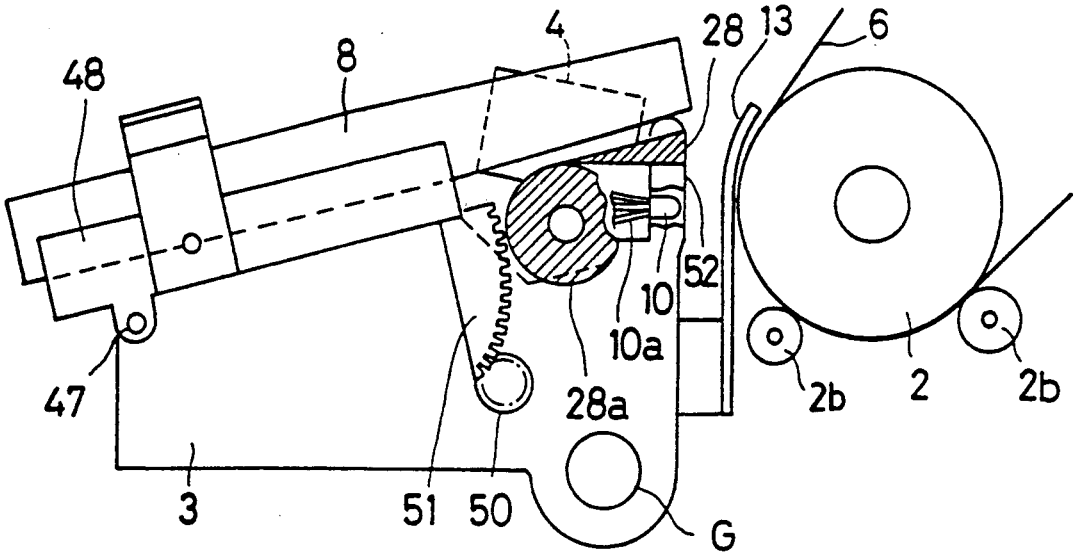

In the above embodiment, although the edge portion of the recording medium 6 and the ribbon end of one ribbon cassette have been detected, in the case of using a further larger number of ribbons, a structure as shown in FIG. 10 can be also considered.

In FIG. 10, in addition to the ribbon cassette 8, a correction tape or other ink ribbon 28 (for instance, a ribbon of a different color or a different ink characteristic or the like) is also provided. That is, the ribbon 28 is wound around a reel 28*a* and is reeved at a position in front of the recording head 4. The ribbon 28 is attached to the frame 48 and is shifted together with the ribbon cassette 8 by shifting the frame 48. In such a case, a high reflectance material is also adhered to the end portion of the ribbon 28 in addition to the end portion of the ribbon 7. The shift position of the ribbon cassette 8 is further controlled into three positions. The end portions of the ink ribbon 7, ribbon 28, and recording medium 6 can be respectively discriminated in correspondence to the shift position. With such a construction, the end portion of the paper and the end portions of a plurality of ribbons can be detected.

Although the above embodiments have been described with respect to the example of the image recording apparatus of the impact recording system, the invention is not limited to such a type. For instance, the invention can be also applied to an image recording system using an ink sheet such as a non-impact recording type of a thermal transfer type or the like. On the other hand, the ink sheets include not only the ink ribbon used in the embodiments but also a wide ribbon or the like.

The alarming portion to alarm the end of the ink sheet is not limited to the portion to which a metal foil or the like used in the embodiments is adhered but may be also realized by, for instance, coloring a paint or printing a high reflectance material or the like. Further, in the case of detecting the alarming portion due to the difference between the reflected light amounts, the invention is not limited to the case shown in the embodiments where the alarming portion is made of a high reflectance material but can be also applied to a construction such that a reflectance of the alarming portion is set to be lower than that of the other back surface of the ribbon. Moreover, the position of the alarming portion to alarm the end of ribbon is not limited to the end of the usable region of the ribbon but may be also set to a position within the usable region. In such a case, the end of ribbon can be warned beforehand.

Further, as detecting means for detecting the alarming portion, it is possible to use well-known means such as photo coupler, laser sensor, or the like in addition to the photo sensor used in the embodiments. Although the embodiments have been described with respect to the example in which the ink sheet is upwardly set when the size of recording medium is detected, the invention is not limited to such an example. For instance, the sensor can be also moved upwardly or downwardly.

As described above, according to the invention, it is possible to provide an image recording apparatus which can improve the performance of the apparatus without increasing the costs.

What is claimed is:

1. A recording apparatus for recording on a recording medium, comprising:

a carriage;

a recording medium mounting portion for mounting the recording medium so it can be conveyed in a conveying direction;

an ink sheet mounting portion, supported on said carriage, for mounting an ink sheet having ink, with the ink sheet including an alarming portion indicating the end of the ink sheet, with said ink sheet mounting portion being reciprocally movable in a first direction across the recording medium and in a second direction along the conveying direction;

recording means for transferring the ink of the ink sheet to the recording medium, thereby recording on the recording medium;

detecting means, supported on said carriage, for detecting a size of the recording medium mounted on said recording medium mounting portion and for detecting the alarming portion on the ink sheet; and driving means for driving said ink sheet mounting portion in the conveying direction and for eliminating the ink sheet from a position in front of said detecting means in order to detect the size of the recording medium.

2. An apparatus according to claim 1, wherein said detecting means generates a signal to stop the recording of said recording means after the alarming position is detected.

3. An apparatus according to claim 1, wherein said detecting means generates a warning signal when the alarming portion is detected before the alarming portion of the ink sheet reaches said recording means.

4. An apparatus according to claim 1, wherein said detecting means detects a width size of the recording medium said generates a signal to set an image recording region of the recording medium.

5. An apparatus according to claim 1, wherein said detecting means has a reflection type photo sensor.

6. A recording apparatus for recording on a recording medium, comprising:

a recording medium mounting portion for mounting the recording medium so that it can be conveyed in a conveying direction;

an ink sheet mounting portion for mounting an ink sheet having ink, with the ink sheet having an alarming portion to indicate the end of the ink sheet, and said ink sheet mounting portion being reciprocally movable in the conveying direction of the recording medium;

a recording head for acting on the ink sheet to record on the recording medium mounted on said recording medium mounting portion;

a carriage which holds said recording head, said carriage being reciprocally movable in a predetermined direction;

a sensor, provided on said carriage, for detecting a width size of the recording medium and for detecting the alarming portion; and control means for controlling said recording head on the basis of the detections made by said sensor.

7. A recording apparatus for recording on a recording medium, comprising:

an ink sheet cassette mounting portion for detachably mounting an ink sheet cassette which encloses therein an ink sheet having ink, the ink sheet having an alarming portion indicating an end of the ink sheet, and said ink sheet cassette mounting portion being reciprocally movable along a conveying path of the recording medium;

a recording head which acts on the ink sheet to record on the recording medium;

a sensor to detect a size of the recording medium and to detect the alarming portion on the ink sheet;

a carriage which holds said recording head and said sensor and is reciprocally movable in a predetermined direction; and driving means for relatively moving the ink sheet and said sensor and for eliminating the ink sheet from a position in front of said sensor in order to detect the size of the recording medium.

8. An image recording apparatus in which an ink ribbon cassette having therein an ink ribbon is mounted and which records an image on a recording medium through the ink ribbon, comprising:

a carriage;

recording means for recording an image on the recording medium;

an ink ribbon cassette mounting member, supported on said carriage, for mounting the ink ribbon cassette, with said ink ribbon cassette mounting member being reciprocally movable in a first direction across the recording medium and in a second direction along a conveying direction of the recording medium;

detecting means, supported on said carriage and arranged to face the ink ribbon, for detecting an end of an effective portion of the ink ribbon and for detecting a size of the recording medium;

and control means for controlling said carriage to move the ink ribbon away from the position facing said detecting means and moving said detecting means to scan the recording medium to detect the width of the recording medium.

* * * * *

UNITED STATES PATENT AND TRADEMARK OFFICE

CERTIFICATE OF CORRECTION

PATENT NO. : 5,150,977

DATED : September 29, 1992

INVENTOR(S) : Junichi Yoshikawa

It is certified that error appears in the above-identified patent and that said Letters Patent is hereby corrected as shown below:

ON THE TITLE PAGE,

[57] ABSTRACT:

Line 22, "apparaatus," should read --apparatus,--.

COLUMN 1:

Line 15, "on" should read --to-- and "to" should read --on--.

COLUMN 2:

Line 2, "miniaturized" should read --miniaturize--.

COLUMN 9:

Line 28, "said" should read --and--.
Line 31, "reflection type" should read --reflection-type--.

COLUMN 10:

Line 43, "medium;" should read --medium; and--.
Line 44, "and" should be deleted.

Signed and Sealed this

Second Day of November, 1993

Attest:

Bruce Lehman

BRUCE LEHMAN

Attesting Officer

Commissioner of Patents and Trademarks